US010804635B2

(12) United States Patent
Song et al.

(10) Patent No.: US 10,804,635 B2
(45) Date of Patent: Oct. 13, 2020

(54) BOARD MATING CONNECTOR IN WHICH SIGNAL CONTACT UNIT AND GROUND CONTACT UNIT ARE INTERLOCKED

(71) Applicant: GigaLane Co., Ltd., Hwaseong-si, Gyeonggi-do (KR)

(72) Inventors: Hwa Yoon Song, Hwaseong-si (KR); Jin Uk Lee, Hwaseong-si (KR); Sun Hwa Cha, Hwaseong-si (KR); Chang Hyun Yang, Hwaseong-si (KR); Eun Jung Kim, Hwaseong-si (KR); Kyung Hun Jung, Hwaseong-si (KR); Hee seok Jung, Hwaseong-si (KR)

(73) Assignee: GigaLane Co., Ltd., Hwaseong-si, Gyeonggi-Do (KR)

( * ) Notice: Subject to any disclaimer, the term of this patent is extended or adjusted under 35 U.S.C. 154(b) by 0 days.

(21) Appl. No.: 16/361,434

(22) Filed: Mar. 22, 2019

(65) Prior Publication Data

US 2019/0305457 A1 Oct. 3, 2019

(30) Foreign Application Priority Data

Mar. 27, 2018 (KR) ..... 10-2018-0034834

(51) Int. Cl.
*H01R 13/24* (2006.01)
*H01R 13/502* (2006.01)
(Continued)

(52) U.S. Cl.
CPC ..... *H01R 13/2407* (2013.01); *H01R 12/91* (2013.01); *H01R 13/2421* (2013.01);
(Continued)

(58) Field of Classification Search
CPC . H01R 13/2407; H01R 12/91; H01R 13/2421
(Continued)

(56) References Cited

U.S. PATENT DOCUMENTS 4,815,986 A * 3/1989 Dholoo ..... H01R 13/631 439/248
5,746,619 A * 5/1998 Harting ..... H01R 24/40 439/352

(Continued)

FOREIGN PATENT DOCUMENTS

CN 104466484 A 3/2015
EP 1289076 A2 3/2003

(Continued)

*Primary Examiner* — Alexander Gilman
(74) *Attorney, Agent, or Firm* — Brundidge & Stanger, P.C.

(57) ABSTRACT

In one example, a board mating connector, in which a signal contact unit and a ground contact unit are interlocked, includes: a signal contact unit which has one side in contact with a signal electrode of a board and is electrically connected to the signal electrode; a ground contact unit which has one side in contact with a ground electrode of the board and is electrically connected to the ground electrode; and a dielectric unit which is disposed between the signal contact unit and the ground contact unit, wherein the ground contact unit includes a ground portion and another ground portion which is relatively moved in contact with the ground portion so as to be coupled to and interlocked with a connection portion through the dielectric unit.

7 Claims, 10 Drawing Sheets

(51) Int. Cl.
*H01R 24/50* (2011.01)
*H01R 12/91* (2011.01)
*H01R 103/00* (2006.01)

(52) U.S. Cl.
CPC ..... *H01R 13/502* (2013.01); *H01R 24/50* (2013.01); *H01R 2103/00* (2013.01)

(58) Field of Classification Search
USPC ..... 439/607.01
See application file for complete search history.

(56) References Cited

U.S. PATENT DOCUMENTS

| | | | | |
|---|---|---|---|---|
| 5,769,652 | A * | 6/1998 | Wider | H01R 13/6315 439/248 |
| 5,980,290 | A * | 11/1999 | Meynier | H01R 13/6315 439/246 |
| 6,497,579 | B1 * | 12/2002 | Garbini | H01R 13/6315 439/246 |
| 8,747,152 | B2 * | 6/2014 | Van Swearingen | H01R 24/40 439/578 |
| 2008/0057782 | A1 | 3/2008 | Berthet et al. | |

FOREIGN PATENT DOCUMENTS

| | | | |
|---|---|---|---|
| EP | 1895625 | A1 | 3/2008 |
| JP | 07336115 | A | 12/1995 |
| JP | 08236227 | A | 9/1996 |
| JP | 2001307811 | A | 11/2001 |
| JP | 3107906 | U | 1/2005 |
| JP | 2017126564 | A | 7/2017 |
| KR | 1020130098047 | A | 9/2013 |

* cited by examiner

100(110,120,130)

100(110,120,130,140)
200(210,220)
201(211,221)
300(310,320)

100(110,120,130,140)
200(210,220)
201(211,221)
300(310,320)

BOARD MATING CONNECTOR IN WHICH SIGNAL CONTACT UNIT AND GROUND CONTACT UNIT ARE INTERLOCKED

CROSS-REFERENCE TO RELATED APPLICATION

This application claims the benefit under 35 U.S.C. § 119 of a Korean patent application No. 10-2018-0034834 filed on Mar. 27, 2018 in the Korean Intellectual Property Office, the entire disclosure of which is hereby incorporated herein by reference.

TECHNICAL FIELD

The embodiments relate to a board mating connector in which a signal contact unit and a ground contact unit are interlocked.

BACKGROUND

As shown in FIG. 1, a board mating connector, which has one side in contact with a board such as a printed circuit board on which a signal wiring is formed and transmits a radio frequency (RF) signal to the board, includes a signal contact unit 100 in contact with a signal pad of the board and a ground contact unit 200 in contact with a ground pad of the board.

The signal contact unit 100 and the ground contact unit 200 are separately operated.

When the board is tilted to come into contact with the board mating connector, although the ground contact unit 200 is tilted to come into contact with the ground pad along with the ground pad of the tilted board, the signal contact unit 100 is not tilted along with the ground contact unit 200. Thus, the signal contact unit 100 is biased to one side to come into contact with the signal pad of the board, and thus, impedance is distorted, or the signal contact unit 100 does not come into contact with the signal pad of the board, and thus, an RF signal is not transmitted to the board.

In addition to such a problem, on the contrary, in a case in which the signal contact unit 100 is tilted to come into contact with the signal pad along with the signal pad of the tilted board, there is a problem in that the ground contact unit 200 is not tilted along with the signal pad.

PRIOR ART DOCUMENTS

Patent Documents (Patent Document 1) KR 10-2015-0080486 A
(Patent Document 2) KR 10-152937 B1
(Patent Document 3) KR 10-152937 B1

SUMMARY

The present invention is directed to providing a board mating connector in which a signal contact unit and a ground contact unit are interlocked.

In one example embodiment, a board mating connector, in which a signal contact unit and a ground contact unit are interlocked, includes a signal contact unit which has one side in contact with a signal electrode of a board and is electrically connected to the signal electrode; a ground contact unit which has one side in contact with a ground electrode of the board and is electrically connected to the ground electrode; and a dielectric unit which is disposed between the signal contact unit and the ground contact unit, wherein the ground contact unit includes a ground portion and another ground portion which is relatively moved while in contact with the ground portion so as to be coupled to and interlocked with the connection portion through the dielectric unit.

The signal contact unit may include a housing which has a housing insertion hole of which one side is open, a contact portion which has a contact portion insertion hole of which the other side is open, and a connection portion which is inserted between the one side of the housing insertion hole and the other side of the contact portion insertion hole; the ground contact unit may include a first ground portion which has a first ground hollow portion and include a second ground portion of which the other side is partially inserted into the first ground hollow portion and which has a second ground hollow portion; and the dielectric unit may include a first dielectric portion which is disposed between the housing and the first ground portion and include a second dielectric portion which is disposed between the connection portion and the second ground portion, wherein, when the second ground portion is moved in a direction of the first ground portion or in a direction opposite to the direction of the first ground portion, the connection portion is moved by the second dielectric portion in a direction in which the second ground portion is moved.

The connection portion may include a first connection hole of which the other side is open; a second connection hole of which one side is open; a first connection protrusion which protrudes from an outer wall of the other end of the connection portion; a second connection protrusion which protrudes from an outer wall of one end of the connection portion; two or more first connection slits which are elongated to one side of the connection portion from the other end thereof along a circumference of the connection portion; and two or more second connection slits which are elongated from the one end of the connection portion to the other side thereof along the circumference of the connection portion.

The board mating connector may further include a signal spring which is inserted between the one side of the second connection hole and the other side of the contact portion insertion hole, wherein, when the contact portion is moved in a direction of the connection portion, the signal spring is compressed by the contact portion, and the compressed signal spring is restored so that the contact portion is moved in a direction opposite to the direction of the connection portion.

The contact portion may further include a contact tapered portion which is formed on an inner wall of the contact portion so as to have an inclined shape such that an inner diameter thereof is gradually decreased toward the other side thereof, wherein, when the contact portion is moved in a direction of the connection portion, an outer diameter of the second connection protrusion is compressed by the contact tapered portion, and the compressed outer diameter of the second connection protrusion is restored in a direction in which an inner diameter of the contact tapered portion is increased so that the contact portion is moved in a direction opposite to the direction of the connection portion.

The second dielectric portion may include two or more second dielectric hollow portions which are formed in a hole shape passing from the other end to one end of the second dielectric portion between the connection portion and the second ground portion.

The board mating connector may further include a ground spring which is disposed between an inner side of the first ground portion and an outer side of the second ground portion, wherein, when the second ground portion is moved in the direction of the first ground portion, the ground spring is compressed by the second ground portion, and the compressed ground spring is restored so that the second ground portion is moved in the direction opposite to the direction of the first ground portion.

The first ground portion may include a ground tapered portion which is formed on an inner wall of the first ground portion so as to have an inclined shape such that an inner diameter thereof is gradually decreased toward the other side thereof, and the second ground portion may include a second ground protrusion which protrudes outward from the other end of the second ground portion and include two or more second ground slits which are elongated to one side of the second ground portion from the other end thereof along a circumference of the second ground portion, wherein, when the second ground portion is moved in the direction of the first ground portion, an outer diameter of the second ground protrusion is compressed by the ground tapered portion, and the compressed outer diameter of the second ground protrusion is restored in a direction in which an inner diameter of the ground tapered portion is increased so that the second ground portion is moved in the direction opposite to the direction of the first ground portion.

The first ground portion may include a ground tapered portion which is formed on an inner wall of the first ground portion so as to have an inclined shape such that an inner diameter thereof is gradually decreased toward the other side thereof, and the second ground portion may include a second ground protrusion which protrudes outward from the other end of the second ground portion and include two or more second ground slits which are elongated to one side of the second ground portion from the other end thereof along a circumference of the second ground portion, wherein, when the second ground portion is moved in the direction of the first ground portion, an outer diameter of the second ground protrusion is compressed by the ground tapered portion, and the compressed outer diameter of the second ground protrusion is restored in a direction in which an inner diameter of the ground tapered portion is increased so that the second ground portion is moved in the direction opposite to the direction of the first ground portion.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

When a signal contact unit 100 and a ground contact unit 200 are separately operated and a board is tilted and brought into contact therewith, although the ground contact unit 200 is tilted to come into contact with a ground pad along with the ground pad of the tilted board, the signal contact unit 100 is not tilted along with the ground contact unit 200. Thus, the signal contact unit 100 is biased to one side to come into contact with the signal pad of the board, whereby impedance is distorted, or the signal contact unit 100 does not come into contact with the signal pad of the board, whereby a radio frequency (RF) signal is not transmitted to the board.

In addition to such a problem, on the contrary, in a case in which the signal contact unit 100 is tilted to come into contact with the signal pad along with the signal pad of the tilted board, there is a problem in that the ground contact unit 200 is not tilted along with the signal pad.

Figure 1:
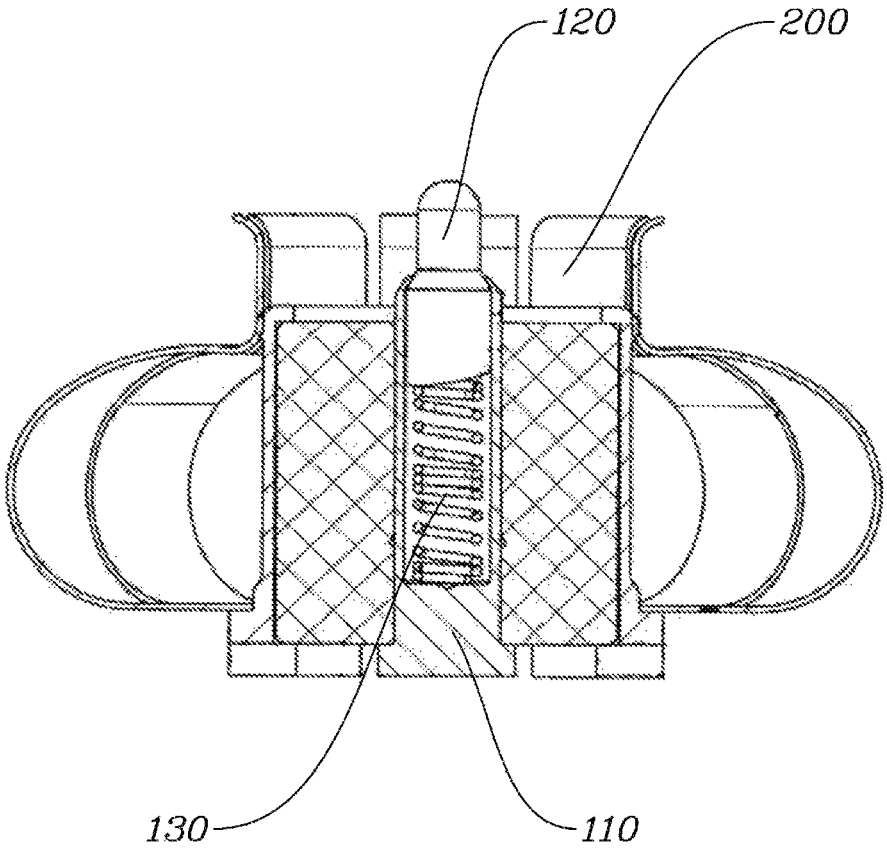
FIG. 1 is a cross-sectional view illustrating the related art.
Figure 2:
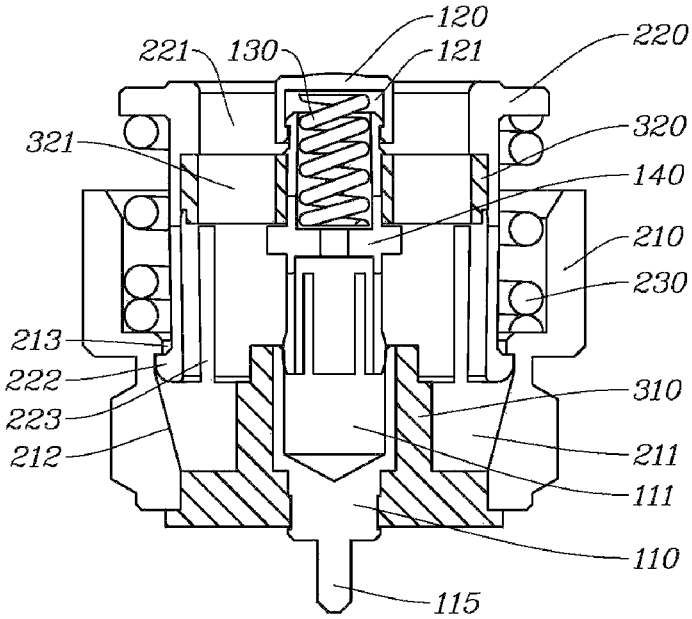
FIG. 2 is a cross-sectional view illustrating a restoration state of a board mating connector.
Figure 3:
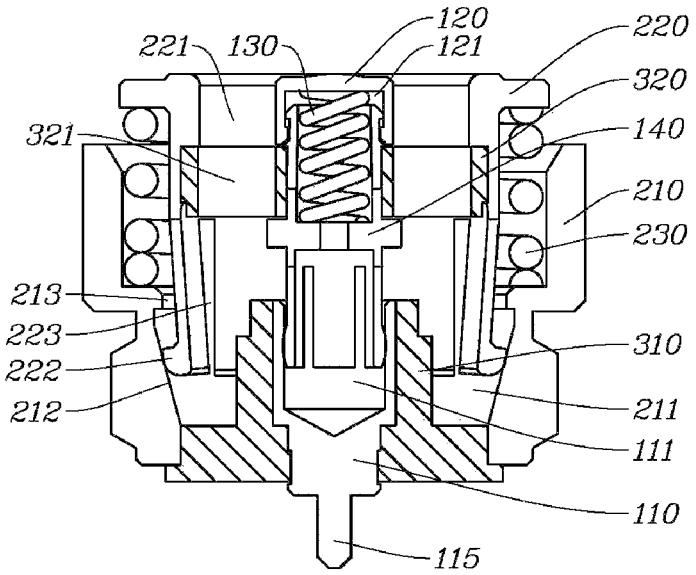
FIG. 3 is a cross-sectional view illustrating a compression state of the board mating connector.

To solve the problems, as shown in FIGS. 2 and 3, a board mating connector according to the present invention includes a signal contact unit 100, a ground contact unit 200, and a dielectric unit 300.

One side of the signal contact unit 100 comes into contact with a signal electrode of a board, and thus, the signal contact unit 100 is electrically connected to the signal electrode.

One side of the ground contact unit 200 comes into contact with a ground electrode of the board, and thus, the ground contact unit 200 is electrically connected to the ground electrode.

The dielectric unit 300 is disposed between the signal contact unit 100 and the ground contact unit 200.

In this case, the ground contact unit 200 includes a first ground portion 210 and a second ground portion 220, which is relatively moved in contact with the first ground portion 210 so as to be coupled to and interlocked with the signal contact unit 100 through the dielectric unit 300.

As a detailed configuration which allows the signal contact unit 100 and the ground contact unit 200 to be interlocked with each other, the signal contact unit 100 includes a housing 110, a contact portion 120, and a connection portion 140.

In addition, the ground contact unit 200 includes the first ground portion 210 and the second ground portion 220.

Furthermore, the dielectric unit 300 includes a first dielectric portion 310 and a second dielectric portion 320.

First, describing the components of the signal contact unit 100, the housing 110 has a housing insertion hole 111 of which one side is open and includes a contact pin 115 formed at the other end thereof.

The contact portion 120 has a contact portion insertion hole 121 of which the other side is open.

The connection portion 140 is inserted between one side of the housing insertion hole 111 and the other side of the contact portion insertion hole 121.

Next, describing the components of the ground contact unit 200, a first ground hollow portion 211 is formed in the first ground portion 210. For example, the other end of the connection portion 140 is inserted to be movable along an inner side of the housing insertion hole 111, and one end of the connection portion 140 is inserted to be movable along an inner side of the contact portion insertion hole 121.

The other side of the second ground portion 220 is partially inserted into the first ground hollow portion 211, and a second ground hollow portion 221 is formed in the second ground portion 220.

Describing the components of the dielectric unit 300, the first dielectric portion 310 is disposed between the housing 110 and the first ground portion 210.

The second dielectric portion 320 is disposed between the connection portion 140 and the second ground portion 220.

Due to such a configuration, as shown in FIG. 3, when the second ground portion 220 is moved in the direction of the first ground portion 210 or a direction opposite to the direction of the first ground portion 210, the second dielectric portion 320 allows the connection portion 140 to be moves together with the second ground portion 220 in a direction in which the second ground portion 220 is moved.

As described above, since the signal contact unit 100 and the ground contact unit 200 are interlocked with each other, the signal contact unit 100 and the ground contact unit 200 are connected accurately within an allowable range in which an RF signal is transmitted to a board, and impedance is not distorted.

Figure 4:
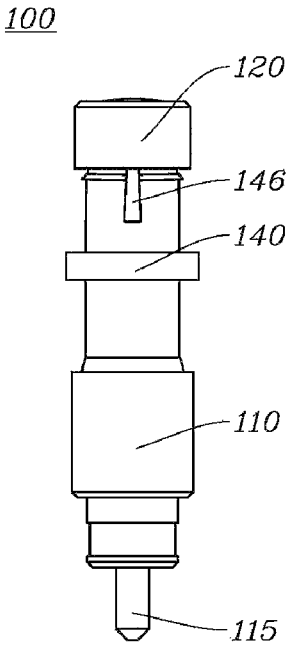
FIG. 4 is a view illustrating an exterior of a signal contact unit.
Figure 5:
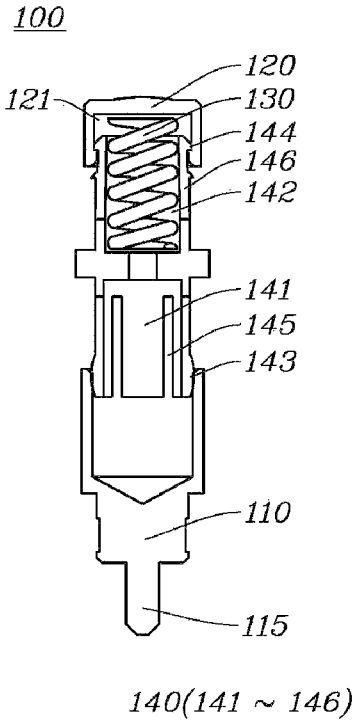
FIG. 5 is a cross-sectional view illustrating a restoration state of the signal contact unit.
Figure 6:
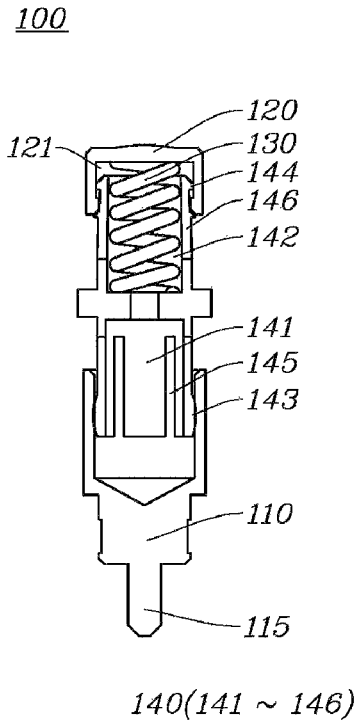
FIG. 6 is a cross-sectional view illustrating a compression state of the signal contact unit.

As shown in FIGS. 4 to 6, the connection portion 140 includes a first connection hole 141, a second connection hole 142, a first connection protrusion 143, a second connection protrusion 144, a first connection slit 145, and a second connection slit 146.

The first connection hole 141 is formed in the connection portion 140 so as to have the other side which is open.

The second connection hole 142 is formed in the connection portion 140 so as to have one side which is open.

The first connection protrusion 143 is formed to protrude from an outer wall of the other end of the connection portion 140.

The second connection protrusion 144 is formed to protrude from an outer wall of one end of the connection portion 140.

The first connection slit 145 is elongated to one side of the connection portion 140 from the other end thereof. Two or more first connection slits 145 are formed along a circumference of the connection portion 140 such that the other end of the connection portion 140 is divided into a plurality of portions.

The second connection slit 146 is elongated from one end of the connection portion 140 to the other side thereof. Two or more second connection slits 146 are formed along the circumference of the connection portion 140 such that one end of the connection portion 140 is divided into a plurality of portions.

Due to such a configuration, as shown in FIG. 6, in a state in which one side of the contact portion 120 comes into contact with the board and the signal contact unit 100 is compressed, the first connection protrusion 143 comes into contact with an inner side of the housing 110, and the second connection protrusion 144 comes into contact with an inner side of the contact portion 120. Accordingly, the housing 110 and the contact portion 120 are electrically connected through the connection portion 140.

A component may be further provided to provide elasticity such that one side of the contact portion 120 stably comes into contact with the board.

Figure 7:
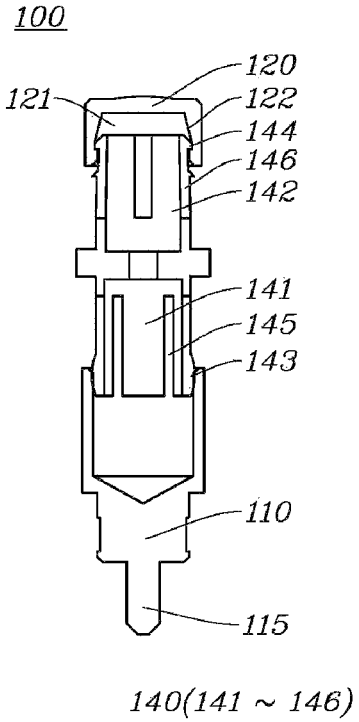
FIG. 7 is a cross-sectional view illustrating a restoration state of a signal contact unit according to another embodiment.

As such an elastic structure, a signal spring 130 may be further provided as shown in FIGS. 5 and 6, or a contact tapered portion 122 may be further included in the contact portion 120 as shown in FIG. 7.

The signal spring 130 is inserted between one side of the second connection hole 142 and the other side of the contact portion insertion hole 121.

In this case, when the contact portion 120 is moved in the direction of the connection portion 140, the signal spring 130 is compressed by the contact portion 120, and the compressed signal spring 130 is restored. Thus, the contact portion 120 is moved in a direction opposite to the direction of the connection portion 140.

The contact tapered portion 122 is formed in an inclined shape such that an inner diameter thereof is gradually decreased toward one side thereof on an inner wall of the contact portion 120.

In this case, when the contact portion 120 is moved in the direction of the connection portion 140, an outer diameter of the second connection protrusion 144 is compressed by the contact tapered portion 122, and the compressed outer diameter of the second connection protrusion 144 is restored in a direction in which an inner diameter of the contact tapered portion 122 is increased. Thus, the contact portion 120 is moved in the direction opposite to the direction of the connection portion 140.

As described above, the component is further provided to provide elasticity when one side of the contact portion 120 comes into contact with the board, whereby one side of the contact portion 120 stably comes into contact with the board.

Figure 8:
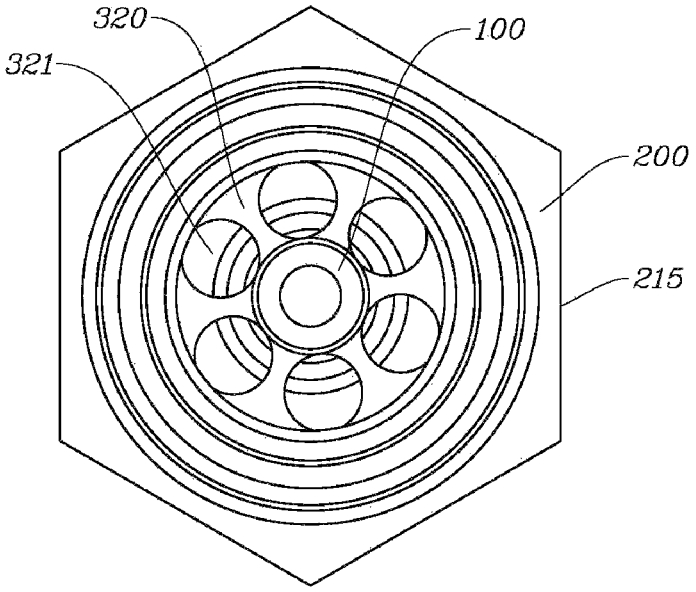
FIG. 8 is a plan view illustrating a board mating connector.

As shown in FIGS. 2, 3, and 8, the second dielectric portion 320 includes a second dielectric hollow portion 321.

The second dielectric hollow portion 321 is formed in a hole shape passing from the other end to one end of the second dielectric portion 320. Two or more second dielectric hollow portions 321 are formed between the connection portion 140 and the second ground portion 220.

As shown in FIG. 3, when the second ground portion 220 is moved in the direction of the first ground portion 210 and when the second dielectric portion 320 approaches the first dielectric portion 310, in order to minimize a change in impedance, which is caused by a dielectric constant of the second dielectric portion 320 being added to a dielectric constant of the first dielectric portion 310, the second dielectric hollow portion 321 is formed in the second dielectric portion 320. Accordingly, an area of the second dielectric portion 320 is decreased.

Therefore, it is possible to minimize the change in impedance.

As shown in FIGS. 2 and 3, the board mating connector according to the present invention further includes a ground spring 230 disposed between an inner side of the first ground portion 210 and an outer side of the second ground portion 220.

As shown in FIG. 3, when one side of the ground contact unit 200 comes into contact with the board and the second ground portion 220 is moved in the direction of the first ground portion 210, the ground spring 230 is compressed by the second ground portion 220, and the compressed ground spring 230 is restored. Thus, the second ground portion 220 is moved in the direction opposite to the direction of the first ground portion 210.

Figure 9:
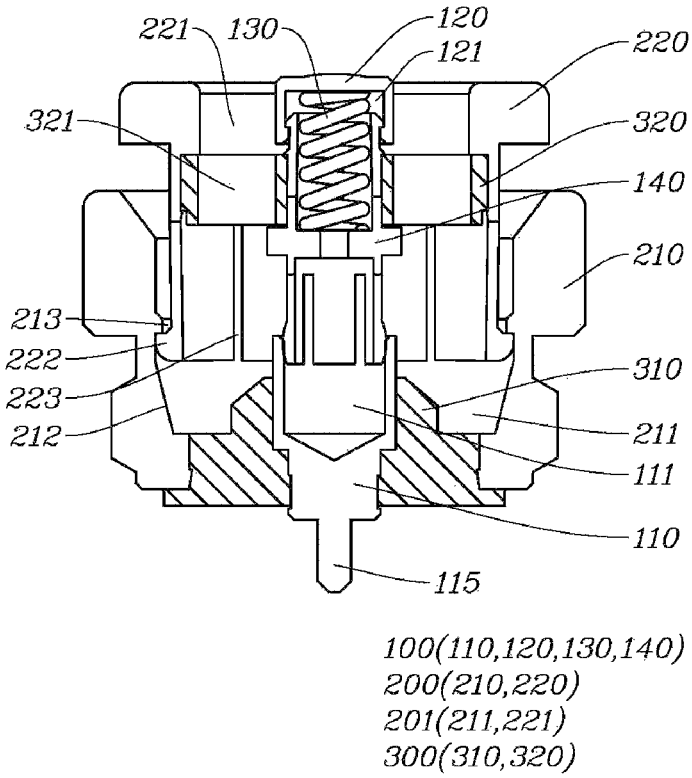
FIG. 9 is a cross-sectional view illustrating a restoration state of a board mating connector according to another embodiment.

As shown in FIGS. 2 and 3, a restoring force to move the second ground portion 220 in the direction opposite to the direction of the first ground portion 210 may be further increased. Alternatively, as shown in FIG. 9, in order to replace the ground spring 230 described above, the first ground portion 210 may include a ground tapered portion 212, and the second ground portion 220 may include a second ground protrusion 222 and a second ground slit 223.

The ground tapered portion 212 is formed in an inclined shape such that an inner diameter thereof is gradually decreased toward the other side thereof on an inner wall of the first ground portion 210.

The second ground protrusion 222 protrudes outward from the other end of the second ground portion.

The second ground slit 223 is elongated to one side of the second ground portion from the other end thereof. Two or more second ground slits 223 are formed along a circumference of the second ground portion such that the other end of the second ground portion 220 is divided into a plurality of portions.

When the second ground portion 220 is moved in the direction of the first ground portion 210, an outer diameter of the second ground protrusion 222 is compressed by the ground tapered portion 212, and the compressed outer diameter of the second ground protrusion 222 is restored in a direction in which an inner diameter of the ground tapered portion 212 is increased, and thus, the second ground portion 220 is moved in the direction opposite to the direction of the first ground portion 210.

In this case, in order to prevent the second ground portion 220 from being moved more than necessary in the direction opposite to the direction of the first ground portion 210, a latch portion 213 may be formed to protrude inward from a wall of the first ground portion 210 at one side of the wall of the first ground portion 210 with respect to a position where the tapered portion 224 is formed.

One side of the second ground protrusion 222 may be caught by the latch portion 213, and thus, the latch portion 213 may prevent the second ground portion 220 from being further moved in the direction opposite to the direction of the first ground portion 210.

As described above, as shown in FIGS. 2 and 3, when the above-described ground spring 230 is further provided, a restoring force due to the ground spring 230 may be added to a restoring force in which the second ground portion 220 is moved in the direction opposite to the direction of the first ground portion 210 by the ground tapered portion 212, the second ground protrusion 222, and the second ground slit 223.

Accordingly, it is possible to further increase the restoring force to move the second ground portion 220 in the direction opposite to the direction of the first ground portion 210.

In addition, as shown in FIG. 9, when the above-described ground spring 230 is not provided, the ground tapered portion 212, the second ground protrusion 222, and the second ground slit 223 may replace the ground spring 230.

Figure 10:
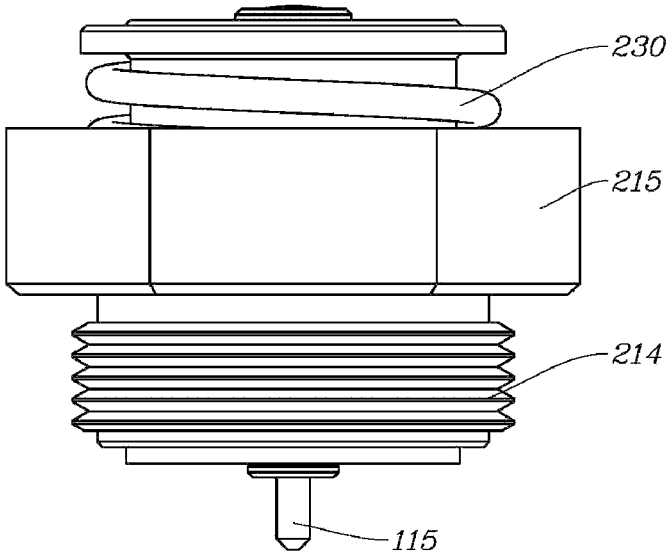
FIG. 10 is a front view illustrating a board mating connector.
Figure 11:
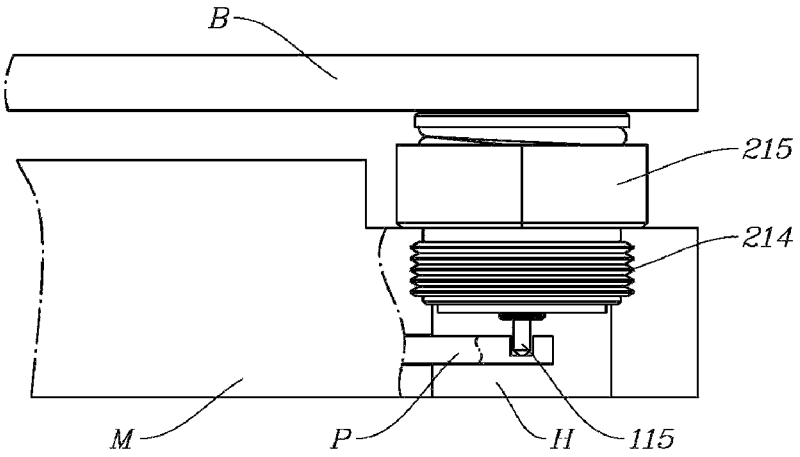
FIG. 11 is a view illustrating a state in which a board mating connector is inserted into a module.

As shown in FIGS. 8, 10, and 11, the first ground portion 210 may include a thread 214 and a tightening portion 215 such that one side of the board mating connector according to the present invention is insertion-coupled to a module using a tool such as a wrench.

The thread 214 is formed on a circumference of the other side of the first ground portion 210.

The tightening portion 215 is formed to have three or more surfaces on a circumference of one side of the first ground portion 210.

As shown in FIG. 11, a module M has a hole H which has a wall corresponding to the thread 214, and the board mating connector is inserted into the hole H.

Here, the contact pin 115 may be electrically connected to a signal electrode pin P protruding toward a center of the hole H.

A board B comes into contact with one side of the board mating connector, and thus, the board mating connector transmits an RF signal to the board B.

As described above, since the thread 214 and the tightening portion 215 are provided such that one side of the board mating connector is insertion-coupled to the module, a contact height of the board B may be lowered. Thus, it is possible to lower a height of the module M including the board mating connector, easily couple the board mating connector, and stably fix the board mating connector.

Figure 12:
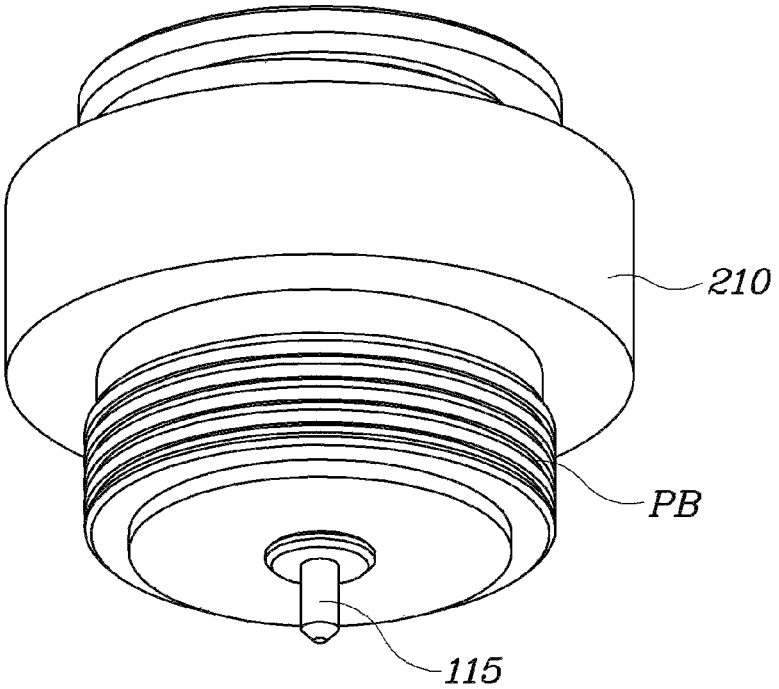
FIGS. 12 to 14 are views illustrating exteriors of board mating connectors.
Figure 14:
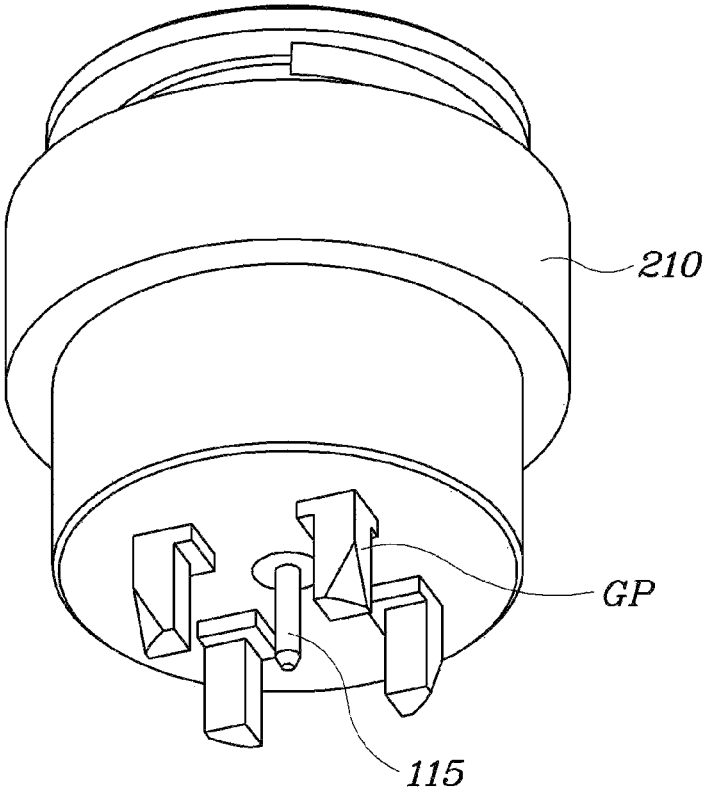

An exterior of the board mating connector according to the present invention is not limited to the above-described shape including the thread 214 and the tightening portion 215 and may be formed in various shapes as shown in FIGS. 12 and 14.

As shown in FIG. 12, a shape of the first ground portion 210 is formed in a cylindrical shape in which a plurality of press-fit protrusions PB are formed at one side of the first ground portion 210 such that the first ground portion 210 is press-fitted into the module.

Figure 13:
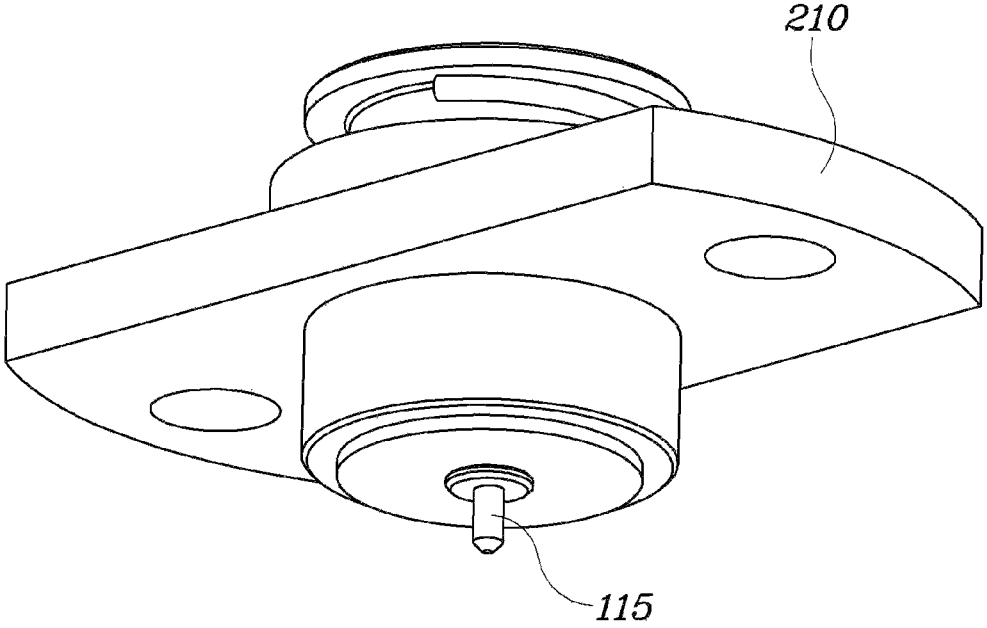

As shown in FIG. 13, the first ground portion 210 is formed in a panel shape in which grooves, to which screws are coupled, are formed on both sides thereof such that the first ground portion 210 is screw-coupled to the module.

As shown in FIG. 14, the first ground portion 210 is formed in a shape in which a plurality of ground pins GP inserted into a printed circuit board (PCB) soldering hole are formed such that the first ground portion 210 is soldered to a PCB.

First, a signal contact unit and a ground contact unit come into contact with each other accurately within an allowable range in which an RF signal is transmitted to a board, and impedance is not distorted.

In addition, one side of a contact portion stably comes into contact with a board.

Furthermore, a change in impedance is minimized.

In addition, a restoring force can be further increased.

Furthermore, it is possible to lower a height of a module including a board mating connector, easily couple the board mating connector, and stably fix the board mating connector.

DESCRIPTION OF REFERENCE NUMERALS

| | |
|---|---|
| 100: signal contact unit | 110: housing |
| 111: housing insertion hole | 115: contact pin |
| 120: contact portion | 121: contact portion insertion hole |
| 122: contact tapered portion | 130: signal spring |
| 140: connection portion | 141: first connection hole |
| 142: second connection hole | 143: first connection protrusion |
| 144: second connection protrusion | 145: first connection slit |
| 146: second connection slit | 200: ground contact unit |
| 210: first ground portion | 211: first ground hollow portion |
| 212: ground tapered portion | 213: latch portion |
| 214: thread | 215: tightening portion |
| 220: second ground portion | 221: second ground hollow portion |
| 222: second ground protrusion | 223: second ground slit |
| 230: ground spring | 300: dielectric unit |
| 310: first dielectric portion | 320: second dielectric portion |
| 321: second dielectric hollow portion | |

We claim:

1. A board mating connector in which a signal contact unit and a ground contact unit are interlocked, the board mating connector comprising:

a signal contact unit which has one side in contact with a signal electrode of a board and is electrically connected to the signal electrode;

a ground contact unit which has one side in contact with a ground electrode of the board and is electrically connected to the ground electrode; and a dielectric unit which is disposed between the signal contact unit and the ground contact unit, wherein the signal contact unit includes a housing which has a housing insertion hole of which one side is open, a contact portion which has a contact portion insertion hole of which one side is open, and a connection portion which has one end inserted to be movable along an inner side of the housing insertion hole and the other end inserted to be movable along an inner side of the contact portion insertion hole, wherein the ground contact unit includes a first ground portion and a second ground portion which is relatively moved while in contact with the first ground portion so as to be coupled to and interlocked with the connection portion through the dielectric unit, and wherein the connection portion includes:

a first connection hole of which one side is open;

a second connection hole of which one side is open;

a first connection protrusion which protrudes from an outer wall of the one end of the connection portion;

a second connection protrusion which protrudes from an outer wall of the other end of the connection portion;

two or more first connection slits which are elongated to one side of the connection portion from the one end thereof along a circumference of the connection portion; and two or more second connection slits which are elongated from the other end of the connection portion to the other side thereof along the circumference of the connection portion.

2. The board mating connector of claim 1, wherein:

the first ground portion has a first ground hollow portion, and one side of the second ground portion is partially inserted into the first ground hollow portion and which has a second ground hollow portion; and the dielectric unit includes a first dielectric portion which is disposed between the housing and the first ground portion and a second dielectric portion which is disposed between the connection portion and the second ground portion, wherein, when the second ground portion is moved in a direction of the first ground portion or in a direction opposite to the direction of the first ground portion, the connection portion moves together with the second ground portion by the second dielectric portion in a direction in which the second ground portion is moved.

3. The board mating connector of claim 2, further comprising a signal spring which is inserted between the one side of the second connection hole and one side of the contact portion insertion hole, wherein, when the contact portion is moved in a direction of the connection portion, the signal spring is compressed by the contact portion, and the compressed signal spring is restored so that the contact portion is moved in a direction opposite to the direction of the connection portion.

4. The board mating connector of claim 2, wherein the contact portion further includes a contact tapered portion which is formed on an inner wall of the contact portion so as to have an inclined shape such that an inner diameter thereof is gradually decreased toward one side thereof, wherein, when the contact portion is moved in a direction of the connection portion, an outer diameter of the second connection protrusion is compressed by the contact tapered portion, and the compressed outer diameter of the second connection protrusion is restored in a direction in which an inner diameter of the contact tapered portion is increased so that the contact portion is moved in a direction opposite to the direction of the connection portion.

5. The board mating connector of claim 2, wherein the second dielectric portion includes two or more second dielectric hollow portions which are formed in a hole shape passing from one end to the other end of the second dielectric portion between the connection portion and the second ground portion.

6. A board mating connector in which a signal contact unit and a ground contact unit are interlocked, the board mating connector comprising:

a signal contact unit which has one side in contact with a signal electrode of a board and is electrically connected to the signal electrode;

a ground contact unit which has one side in contact with a ground electrode of the board and is electrically connected to the ground electrode; and a dielectric unit which is disposed between the signal contact unit and the ground contact unit, wherein the signal contact unit includes a housing which has a housing insertion hole of which one side is open, a contact portion which has a contact portion insertion hole of which one side is open, and a connection portion which has one end inserted to be movable along an inner side of the housing insertion hole and the other end inserted to be movable along an inner side of the contact portion insertion hole, wherein the ground contact unit includes a first ground portion and a second ground portion which is relatively moved while in contact with the first ground portion so as to be coupled to and interlocked with the connection portion through the dielectric unit, wherein the board mating connector further comprises a ground spring which is disposed between an inner side of the first ground portion and an outer side of the second ground portion, wherein, when the second ground portion is moved in the direction of the first ground portion, the ground spring is compressed by the second ground portion, and the compressed ground spring is restored so that the second ground portion is moved in the direction opposite to the direction of the first ground portion, wherein the first ground portion includes a ground tapered portion which is formed on an inner wall of the first ground portion so as to have an inclined shape such that an inner diameter thereof is gradually decreased toward one side thereof, wherein the second ground portion includes a second ground protrusion which protrudes outward from one end of the second ground portion and two or more second ground slits which are elongated to one side of the second ground portion from the one end thereof along a circumference of the second ground portion, and wherein, when the second ground portion is moved in the direction of the first ground portion, an outer diameter of the second ground protrusion is compressed by the ground tapered portion, and the compressed outer diameter of the second ground protrusion is restored in a direction in which an inner diameter of the ground tapered portion is increased so that the second ground portion is moved in the direction opposite to the direction of the first ground portion.

7. A board mating connector in which a signal contact unit and a ground contact unit are interlocked, the board mating connector comprising:

a signal contact unit which has one side in contact with a signal electrode of a board and is electrically connected to the signal electrode;

a ground contact unit which has one side in contact with a ground electrode of the board and is electrically connected to the ground electrode; and a dielectric unit which is disposed between the signal contact unit and the ground contact unit, wherein the signal contact unit includes a housing which has a housing insertion hole of which one side is open, a contact portion which has a contact portion insertion hole of which one side is open, and a connection portion which has one end inserted to be movable along an inner side of the housing insertion hole and the other end inserted to be movable along an inner side of the contact portion insertion hole, wherein the ground contact unit includes a first ground portion and a second ground portion which is relatively moved while in contact with the first ground portion so as to be coupled to and interlocked with the connection portion through the dielectric unit, wherein the first ground portion includes a ground tapered portion which is formed on an inner wall of the first ground portion so as to have an inclined shape such that an inner diameter thereof is gradually decreased toward one side thereof, wherein the second ground portion includes a second ground protrusion which protrudes outward from one end of the second ground portion and two or more second ground slits which are elongated to one side of the second ground portion from the one end thereof along a circumference of the second ground portion, and wherein, when the second ground portion is moved in the direction of the first ground portion, an outer diameter of the second ground protrusion is compressed by the ground tapered portion, and the compressed outer diameter of the second ground protrusion is restored in a direction in which an inner diameter of the ground tapered portion is increased so that the second ground portion is moved in the direction opposite to the direction of the first ground portion.

* * * * *